US005474176A

United States Patent [19]

Schenkkan

[11] Patent Number: 5,474,176

[45] **Date of Patent: * Dec. 12, 1995**

[54] GOLF BAG WITH INTEGRATED STAND

[76] Inventor: Robert W. Schenkkan, 5022 Galway Cir., Huntington Beach, Calif. 92649-1211

[ * ] Notice: The portion of the term of this patent subsequent to Feb. 21, 2012, has been disclaimed.

[21] Appl. No.: 240,637

[22] Filed: Jun. 27, 1994

Related U.S. Application Data

[63] Continuation-in-part of Ser. No. 16,728, Feb. 11, 1993, Pat. No. 5,390,788.

[51] Int. Cl.[6] ..... A63B 55/00; A63B 55/06

[52] U.S. Cl. ..... 206/315.7; 206/315.3; 206/315.6; 248/96

[58] Field of Search ..... 206/315.2–315.7; 248/96; 211/70.2

[56] References Cited

U.S. PATENT DOCUMENTS

| | | | |
|---|---|---|---|
| 1,404,559 | 1/1922 | Watrous | 248/96 |
| 1,471,766 | 10/1923 | Wolfe | 206/315.7 X |
| 1,591,914 | 7/1926 | Farish | 206/315.7 X |
| 1,672,549 | 6/1928 | Thompson | 206/315.6 |
| 1,683,838 | 9/1928 | Mooney | 206/315.7 X |
| 1,970,849 | 8/1934 | Gunther | 248/96 |
| 2,186,491 | 1/1940 | Meyer | 206/315.7 |
| 2,282,842 | 5/1942 | Abell | 206/315.7 X |
| 2,283,125 | 5/1942 | Bright | 248/96 X |
| 2,571,088 | 10/1951 | Walton | 248/96 |
| 4,311,178 | 1/1982 | Kennedy | 206/315.6 |
| 4,506,854 | 3/1985 | Kim | 248/96 |
| 4,676,464 | 6/1987 | Reimers | 206/315.7 X |
| 4,778,136 | 10/1988 | Reimers | 206/315.7 |
| 4,834,235 | 5/1989 | Solheim et al. | 206/315.7 |
| 4,921,192 | 5/1990 | Jones | 248/96 |
| 4,949,844 | 8/1990 | Yang | 206/315.7 |
| 5,029,703 | 7/1991 | Dulyea, Sr. | 206/315.7 |
| 5,036,974 | 8/1991 | Ross, Jr. | 206/315.7 |
| 5,042,654 | 8/1991 | Jones | 206/315.7 X |
| 5,042,703 | 8/1991 | Izzo | 206/315.3 X |
| 5,082,218 | 6/1992 | Hoffman | 206/315.7 X |
| 5,154,377 | 10/1992 | Suk | 206/315.7 X |
| 5,221,030 | 6/1993 | Cretinon | 206/315.3 X |
| 5,390,778 | 2/1995 | Schenkkan | 206/315.7 |

FOREIGN PATENT DOCUMENTS

| | | | |
|---|---|---|---|
| 6317 | of 1895 | United Kingdom | 248/96 |
| 11777 | of 1896 | United Kingdom | 206/315.6 |
| 157632 | 1/1921 | United Kingdom | 206/315.6 |
| 180224 | 5/1922 | United Kingdom | 206/315.6 |

*Primary Examiner*—Sue A. Weaver
*Attorney, Agent, or Firm*—Charles H. Thomas

[57] ABSTRACT

A golf bag is supported in semi-upright disposition by a tripod stand that is automatically extended when the bag is placed on the ground and when tension is released from the shoulder strap or carry handle handgrip. When the bag is lifted by the shoulder strap or carry handle handgrip, the stand automatically retracts by means of a cord attached to the shoulder strap and handgrip. When the stand is in its fully extended position, it has a configuration generally in the form of a wishbone. The bag also provides interchangeable pockets and diameter compensating compartments for golf club organization and storage. The bag also has a strap and sliding buckle connected to the carry handle handgrip to securely retract the stand for storage.

6 Claims, 7 Drawing Sheets

GOLF BAG WITH INTEGRATED STAND

The present application is a continuation in part of U.S. application Ser. No. 016,728, filed on Feb. 11, 1993, and which issued as U.S. Pat. No. 5,390,788 on Feb. 21, 1995.

BACKGROUND OF THE INVENTION

1. Field of the Invention

The present invention relates to a golf carry bag having an integrated stand that deploys automatically.

2. Description of the Prior Art

Various types of golf carry bags have existed that employ different types of integrated golf bag stand mechanisms. These prior systems include extensible stands, collapsible stands, and automatic stands. Prior U.S. Pat. No. 4,834,235 describes an extensible stand utilizing an elongated, collapsible tubular body for support and a toggle mechanism that moves the stand from a retracted to an extended position.

Prior U.S. Pat. No. 4,506,854 describes a collapsible bag and stand with a removable support assembly, an upright tubular support, and a spring loaded mechanism to support the collapsible bag.

Prior U.S. Pat. No. 4,778,136 discloses an automatic, integrated stand that is controlled by a series of three webbings in conjunction with a bag strap and elasticized shock cords.

U.S. Pat. No. 5,036,974 describes an automatic stand with legs that swing outwardly from adjustable, attached carrying plates.

While prior integrated stands address the need for lightweight, easy horizontal manipulation of the bag in addition to automatic extension and retraction of the stand, most of the prior devices require the use of a shoulder strap to retract the legs of the stand. While a shoulder strap provides an effective method of leg retraction when the golf bag is to be carried a lengthy distance by the user, the necessity for shouldering the bag when walking short distances is awkward and time consuming.

On a golf course a golfer frequently is confronted with situations in which the golf bag need only be transferred short distances. Such circumstances frequently arise near the areas of the golf tee positions and near the golf greens. When travelling short distances utilizing golf bags having conventional automated and integrated stands, the golfer must either hoist the bag by the shoulder strap to retract the legs or lift the bag by its collar and attempt to carry the bag without retracting the legs. This is particularly awkward since, in order to lift the bag, the golfer must approach it from the direction in which the legs extend, since the bag necessarily leans in that direction. This requires the golfer to attempt to maneuver around the extended legs of the stand, which protrude laterally approximately 19 inches from the base of the bag. A golfer is quite likely to trip over the legs while carrying the bag by the collar. In any event, transportation of the bag in this manner is awkward and inconvenient.

When a bag is lifted by the carry handles in prior U.S. Pat. No. 4,778,136, the legs are not retracted and the bag rotates forward due to the weight of the golf clubs. This forward rotation of the bag, in addition to the extension of the legs of the stand, causes the deployed stand to impede and obstruct the golfer's legs when moving the bag short distances.

U.S. Pat. No. 4,921,192 describes a golf carry bag with an integrated stand that allows a golfer to carry the bag in a retracted position with either a carry handle or a shoulder strap. The combination of the golf bag and integrated stand of the present invention differs from this device however. This is because the leg stand in the '192 patent is extended by placing the bag on the ground, which releases a plunger-type device that otherwise holds the legs in place. However, this prior device presents the golfer with problems when playing on uneven terrain. When deploying the golf bag on a hillside or in a valley, as often occurs during a round of golf, the golf bag of the '192 patent and its stand must be precisely placed to ensure contact between the ground and the leg stand plunger. If adequate contact between the ground and plunger does not exist, the leg stand will not extend.

The present invention provides a golf bag that includes both a shoulder strap retraction device and a carry handle retraction device in the form of a handgrip. The golf bag of the present invention has an integrated stand that deploys automatically when the base of the bag is rested on the ground and the bag is released. In addition, the stand may be automatically retracted either by shouldering the bag by means of the strap or by lifting the bag with the handgrip. By providing a golf bag with a handgrip operated retraction device, the golfer is able to lift the bag by means of the handgrip, thereby retracting the legs of the stand. The golfer can then carry the bag short distances with the stand retracted and without the necessity of hoisting the bag onto the golfer's shoulder. Since the legs of the stand are retracted by means of the handgrip, they do not project laterally from the bag and do not interfere with the golfer's legs while walking with the bag.

In the present invention the shoulder strap of the bag is used to retract the legs while walking long distances. On the other hand, the handgrip retraction handle is used to retract the legs of the stand while carrying the bag short distances.

Unlike prior art devices, the leg stand of the present invention extends automatically when tension is released from either the handgrip or shoulder strap. This allows a golfer to easily place the bag at any position or angle created by the terrain on a golf course.

The present invention also provides greater leverage when retracting the legs by either the shoulder strap or carry handles. By utilizing a cord, the present invention allows a golfer to retract the legs with only a three inch pull on the shoulder strap. In prior art devices which employ less leverage, a four to five inch pull on the strap is required to retract the legs.

In addition to the greater leverage provided when retracting the leg stand, the present invention also minimizes or eliminates the problem of leg stand jamming. The leg stands of prior art devices frequently become jammed in the retracted positions. This often occurs because the webbings that connect and activate conventional leg stand extension mechanisms become obstructed. In U.S. Pat. No. 4,778,136 an external pocket is sewn over areas through which the webbings must run to retract the leg stand. If an article of clothing or a hand towel is placed in the pocket, pressure exerted on the webbings frequently obstructs free movement of the webbing and prevents the legs from extending properly.

The present invention solves this problem by retracting the legs by means of an internal cord housed in a protected channel that extends through the structure of the golf bag. The channel is designed to provide an unobstructed pathway for a cord that extends between the leg extension and retraction mechanism and the handgrip. The unobstructed pathway provided for the movement of the cord virtually eliminates leg jamming difficulties.

The golf bag of the present invention differs from conventional prior art systems in that it utilizes a wishbone design that allows the retracted legs to be stored in a single, recessed housing. That is, an elongated, concave outwardly facing channel or recess is defined in the front of the bag to extend the length thereof. The legs, when retracted, are pulled completely into the channel, thus avoiding the likelihood of snagging on articles of clothing. Conventional prior art golf bags have employed various housing systems. However, none of these prior systems features a single housing for storing the legs of the stand which are folded together in a single, longitudinal channel.

U.S. Pat. No. 4,798,357 describes a bag stand utilizing a sliding cam connected through linkage to two folding legs. The legs are separated from each other in both the extended and retracted positions. In prior U.S. Pat. Nos. 4,676,464; 4,778,136; 4,834,235; 4,949,844; and 5,036,974 separate storage arrangements are provided for each of the legs. In U.S. Pat. No. 5,042,654 there is a single storage arrangement for both retracted legs but the storage apparatus is external, as contrasted to the recessed storage cavity of the present invention.

Not only does the golf bag of the present invention provide for retraction of the legs of the stand together and into a single, recessed cavity, but it also provides for an increased distance between the distal ends of the legs when the legs of the stand are deployed to support the beg. This creates a greater tripod area between the base of the bag and the distal extremities of the two legs, and increases the stability of the stand.

The present invention also addresses another problem encountered in bags of conventional design. Specifically, when golf club handles become lodged against each other at the base of the bag, they resist the attempts of a golfer to easily pull any club from the bag. This problem is compounded in lightweight bags having narrow configurations, since the base of the bag has the same diameter as the collar. Because the diameters of the clubs are greater at their grips than at the ends of their shanks adjacent the golf club heads, the golf club handles tend to become jammed together at the bottom of the bag near their grips. The present invention solves this problem by providing the golf bag with a base that has an area larger than the area at its collar. As a result the bag is slightly conical in shape and has more room at the base than at the collar. This configuration also increases the stability of the bag when the stand is extended.

The present invention further reduces the likelihood of golf club jamming by providing the bag with walled cavities within the cross sectional area of the bag. These cavities are formed by fabric partitions which extend the length of the bag between the base and the collar. These partitions form segregating, elongated cavities, separated from each other both left-to-right and front-to-back.

The present invention also provides pockets on the golf bags that are interchangeable. These interchangeable pockets allow a golfer to change the pockets to accommodate seasonal weather changes or to reduce the weight and bulk of the bag.

The present invention provides a system for organizing the golf clubs to be carried that differs from that disclosed in U.S. Pat. No. 5,029,703. The golf bag of the present invention has six different compartments for golf clubs, instead of three compartments as described in the '703 patent. The golf bag of the present invention also differs from the prior art in that the bag of the present invention has a larger diameter at its base than at its collar. This provides a larger area for golf organizing compartments.

Another feature of the present invention that is not addressed by prior art devices is the aesthetic appearance of the golf bag when the stand is in a retracted, stored position. The present invention provides a formed, recessed housing designed to accommodate the retracted stand mechanism, including both of the legs, in a single, nested shroud that is flush with the front body of the bag. Thus, the retraction mechanism is to a large extent hidden from view and tightly secured in a cavity provided for this purpose when not in use.

The prior art provides no design for a recessed housing or permanent retraction mechanism in an automatic bag stand. Because of this shortcoming, as well as the other deficiencies described, conventional self-supporting golf bags fall short of addressing some of the problems of golfers who prefer to walk and carry a golf bag having an integrated stand.

Because of the inadequacies of prior art devices, the need exists for a golf bag with a new and improved design, including an integrated stand that overcomes the problems of short distance walking, leg jamming, club organization, instability, lack of personal customization, and cosmetic appearance. One of ordinary skill in the art will undoubtedly appreciate the simple, yet effective solutions achieved by the present invention.

SUMMARY OF THE INVENTION

The present invention involves a new and improved combination golf bag and stand in which the stand has a wishbone design and is integrated into a combination with the bag. The present invention provides a highly effective system of golf club organization, pocket customization, and cosmetic enhancement.

In one broad aspect the present invention may be defined as a golf bag and automated stand for supporting the bag in an upright disposition. The golf bag has a front and a back and is suited for holding and organizing golf clubs. The bag has a collar at its upper extremity and a base at its lower extremity. The bag also includes a housing extending between the collar and the base at the front of the bag. This housing defines therein a single, concave, elongated recess that extends longitudinally along the front of the bag.

The automatic bag stand includes a pivot bar that has first and second ends. A pivot bar hinge rotatably attaches the first end of the pivot bar to the collar at the front of the bag so that the second end of the pivot bar is rotatable outwardly from the bag. A spring biases the pivot bar so as to urge the second end of the pivot bar to rotate outward away from the bag. The bag stand also includes a pair of legs having upper and lower extremities. Leg connections join the upper extremities of the legs to the second end of the pivot bar so that the legs are rotatable relative to the pivot bar and extend therefrom. The stand also includes a leg extension and retraction means that is coupled to the legs and to the pivot bar. The leg extension and retraction means forces the lower extremities of the legs apart from each other when the second end of the pivot bar is rotated outward away from the bag. The leg extension and retraction means collapses the lower extremities of the legs together when the bias of the spring is overcome.

The system also includes a cord passing through the bag from back to front. The cord is coupled to the leg extension and retraction means. An activation handgrip is provided and has an upper extremity and a lower end. A handgrip hinge connects the upper extremity of the handgrip to the collar at the back of the bag. The lower end of the handgrip is connected to the cord. In this way, when the lower end of the handgrip is pulled outwardly away from the back of the bag, the cord draws the leg extension and retraction means toward the front of the bag so that the legs are collapsed together and pulled into the single, longitudinal recess. When the handgrip is released, the spring pushes the bar outward from the bag and the lower extremities of the legs are forced apart.

In the wishbone design of the integrated bag sand of the invention, the pivot bar rotates outward from the front of the bag collar under the control of the spring. The spring operates to push the lower end of the pivot bar outward when the golfer sets the bag down and releases tension on the carry handle handgrip or shoulder strap.

As the second or lower end of the pivot bar rotates outwardly from the front of the bag, a rod extending from a rotatable connection on the collar beneath the pivot bar hinge causes a slide to retract into the bar. The pivot bar is hollow and the slide is captured within the lateral confines of the pivot bar and is moveable longitudinally therealong. The end of the rod opposite the end thereof coupled to the collar is joined to the slide by mounting ears on the slide that face the front of the bag and project through a longitudinal slot in the pivot bar. The rod is joined to the slide by a rotatable connection to the mounting ears. Since the rod is of a fixed length, as the lower or second end of the pivot bar rotates outward away from the front of the bag, the rod causes the slide to be retracted into the bar, moving from the second or lower end thereof, toward the end secured to the collar by the bar hinge.

The leg extension and retraction means also includes a pair of lever struts. The lever struts are both connected to the slide at a common rotational connection, and extend laterally where they are each joined to rotational pin connections on the legs between the first and second ends of the legs. As the pivot bar is rotated outwardly, the slide is drawn up into the pivot bar, thus forcing the distal of the ends of the lever struts apart. As the slide is retracted into the pivot bar, it pulls the two lever struts to a perpendicular orientation relative to the slide. When the leg extension and retraction mechanism fully deploys the stand, the two lever struts project laterally outwardly from each other, in generally perpendicular alignment relative to the slide and, together with the slide, assume an inverted generally "T-shaped" configuration. Thus, in an inverted, open position the leg extension and retraction means resembles an inverted wishbone.

The leg extension and retraction means is operated by means of a cord that runs from the carry handle handgrip on the back of the bag to a sliding anchor plate that is moveable in reciprocal fashion within the pivot bar, independently of the slide. The end of the cord remote from the carry handle handgrip is attached to the anchor plate and extends through the longitudinal slot in the pivot bar that faces the front of the bag.

Within the bag there is a transverse, tubular enclosure that extends from the front to the back of the bag, thus forming a tubular passageway. The cord is housed within the tubular passageway that is located internally within the structure of the bag. The stand of the invention is retracted in one movement by lifting the bag by either the carry handle or the shoulder strap that is also attached to the carry handle. Either action rotates the carry handle outwardly away from the back of the bag, thereby drawing on the cord. Tension on the cord, in turn, pulls the pivot bar inwardly toward the front of the bag, overcoming the bias of the spring. As the pivot bar is drawn in toward the bag, the rigid rod holds the slide at a fixed distance away from the rod hinge. This forces the slide longitudinally along the pivot bar away from the first end and toward the second end thereof. As a result, the lever struts are collapsed toward each other thereby drawing the legs of the stand inwardly together.

When a golfer wishes to set down the bag of the present invention, the base of the bag is simply placed on the ground and tension is released from the shoulder strap or carry handle handgrip. Upon release of this tension, the force of the spring mechanism causes the legs to automatically extend. To retract the leg stand, the golfer lifts the bag by either the shoulder strap or carry handle. This collapses the legs into the longitudinal channel in the front of the bag and allows the golfer to grasp the carry handle handgrip and retract the leg stand while walking short distances. If the golfer wished to carry the bag for longer distances, the bag can be slung over the shoulder. In this case tension on the shoulder strap is transmitted to the handgrip, likewise pulling the handgrip out away from the back of the bag. Thus, in either event the cord will retract the leg stand.

One of the objects of the configuration of the invention is to create a larger tripod area. This increases bag stability when the bag is rested on the ground with the stand deployed. A related object is to extend the pivot region of the two legs to provide a more open area forwardly of the bag. That is, the distal ends of the legs are spread quite far apart, relative to conventional leg supporting systems for golf bags.

The bag is preferably constructed so that the upper rear extremity of the collar is provided with an opening. The opening is big enough to accommodate the fingers of a golfer's hand. Thus, the upper rear extremity of the collar forms a handhold by means of which it may be grasped with one hand. The handhold on the collar of the bag is provided to allow the golfer to carry the bag by means of the handhold with the leg stand extended, if desired.

The golf club organization system in the bag provides left-to-right golf club separation, as well as front-to-back separation by means of three compartments on both sides of the tubular cord enclosure, as well as front-to-back separation between the three compartments on each side of the bag. The sets of compartments on each side of the bag are bisected by vertical dividers, which create a total of six compartments. The base molding of the bag is 25 percent larger than the collar molding and is designed to prevent the grip ends of the handles of the golf clubs from becoming lodged in the base of the bag. The slight conical shape of the golf bag of the invention allows greater room for club organization and increases the stability of the bag when the bag is rested on the ground.

Another object of the invention is to enhance the aesthetic appearance of the bag. This aesthetic enhancement is achieved by providing a recessed housing for the legs and leg stand. The legs and leg stand thereby are collapsed together into the longitudinal channel at the front of the bag. The legs reside flush with the front body of the carry bag. The sleek appearance of the leg stand in its collapsed condition running the length of the bag and exhibiting a relatively smooth, outer surface is a unique and welcome design.

The invention may be described with greater clarity and particularity with reference to the accompanying drawings.

DESCRIPTION OF THE EMBODIMENT

Figure 1:
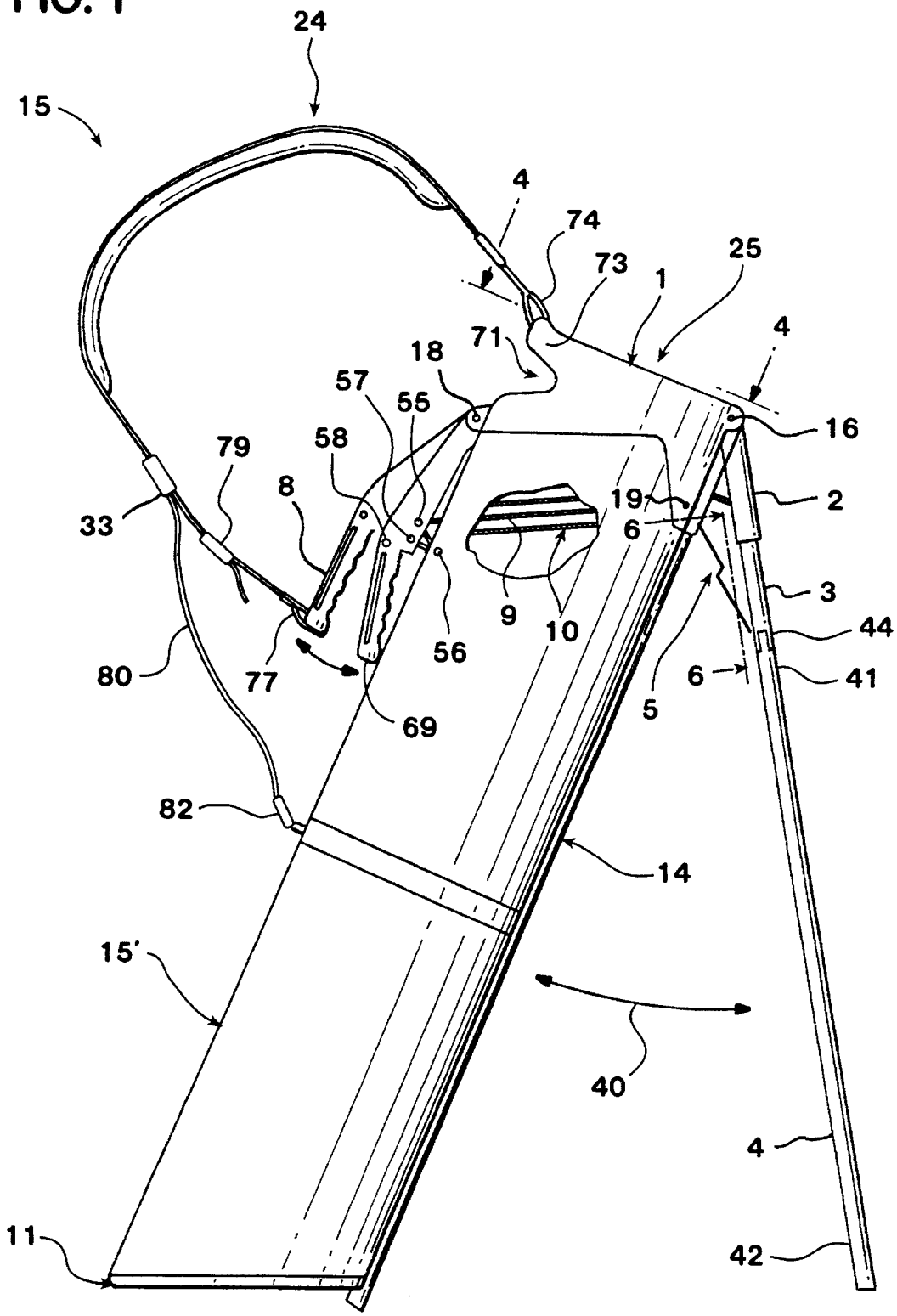
FIG. 1 is a side elevational view of the golf bag and stand combination of the present invention showing the legs extended.
Figure 2:
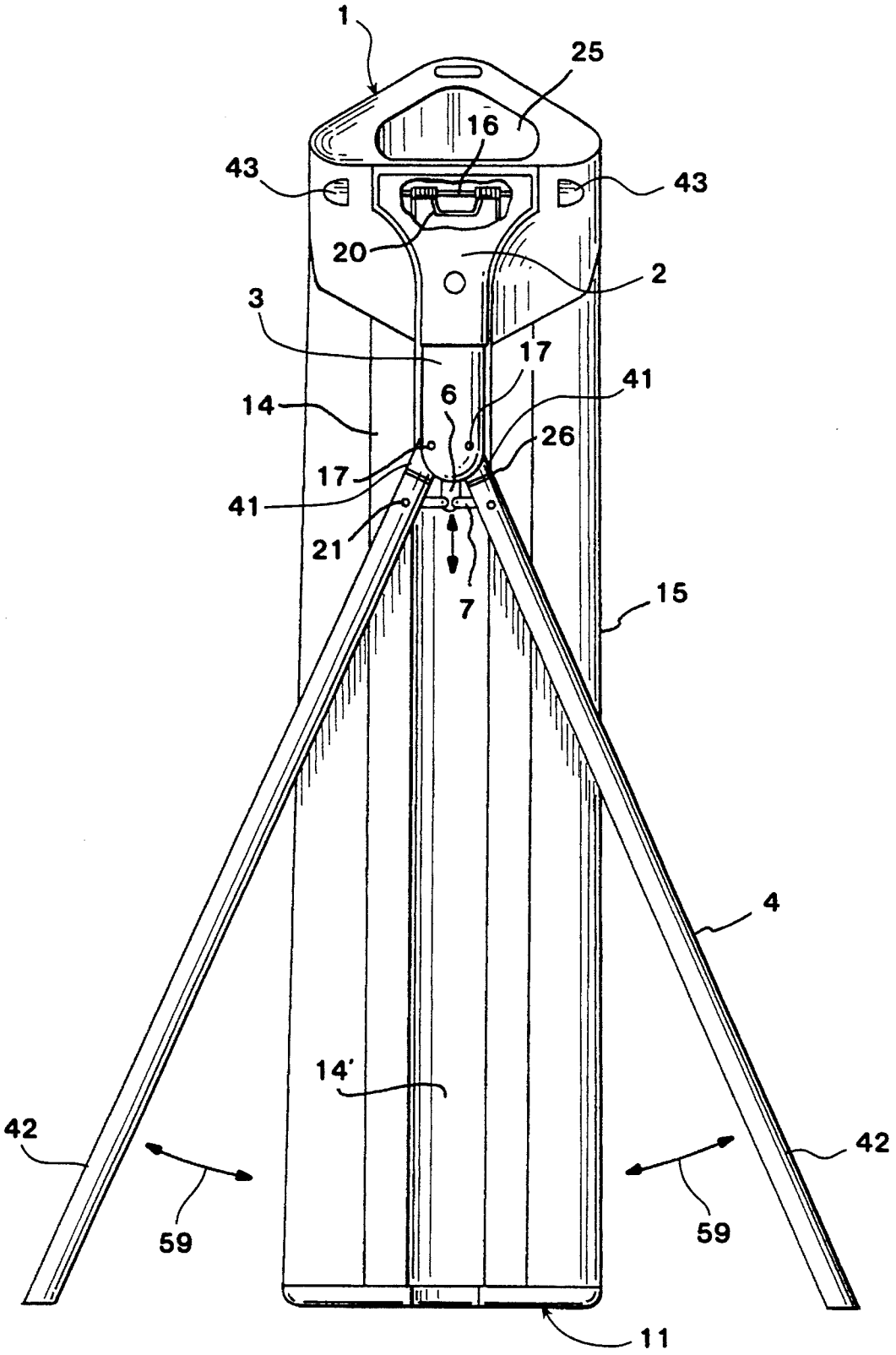
FIG. 2 is a front elevational view of the golf bag and stand combination as shown in FIG. 1, a portion of which has been broken away to allow illustration of the spring.

FIGS. 1 and 2 illustrate the golf bag and leg stand combination of the invention in which the combination is indicated generally at 15. The golf bag and leg stand combination 15 employs a golf bag 15' which is formed as a slightly conical, hollow structure, a bit narrower at the top than at the bottom. The golf bag 15' has a fabric covered outer surface intermediate its opposite upper and lower ends. The fabric bag 15' is secured to a base molding 11 located at the bottom of the golf bag 15' and to a collar molding 1 at the top of the bag 15'. The upper collar 1 is formed of a durable, rigid plastic molding. The collar 1 surrounds the opening 25 at the top of the bag 15'.

The collar molding 1 is basically the foundation structure for the operating mechanism of the automatic stand in the golf bag-leg stand combination 15. The base molding 11 has an area approximately 25 percent greater than the collar molding 1. This greater area accommodates the greater area required for the aggregated diameters of the golf club handles at the grip ends which are stored proximate the bottom of the bag 15'.

FIG. 1 shows the preferred embodiment of the golf bag and stand combination 15 in the position it assumes when the legs of the stand are extended. The directional arrow 40 indicates the rotational movement that the stand undergoes when the stand mechanism moves between the extended and retracted positions. The combination 15 relies upon the operation of a leg extension and retraction mechanism to move between the extended and retracted positions. The leg extension and retraction means is comprised of a pivot bar 3, a slide 6, a pair of lever struts 7, and a rigid rod 5.

As shown in the drawings, the two legs 4 are elongated, hollow aluminum structures having upper extremities indicated generally at 41 and lower ends indicated generally at 42. The two legs 4 are of a lightweight, extruded metal such as aluminum, and are each formed in a generally "D-shaped" cross section that enables the flat, facing sides of the legs 4 to be collapsed together to assume generally the same cross section as that of the pivot bar 3. This results in an aesthetically pleasing appearance of a single, elongated, recessed bar of generally uniform cross section throughout it length when the legs 4 are collapsed together.

The stand mechanism includes a pivot bar 3 having first and second ends. At its first end the pivot bar 3 terminates in a pivot bar base molding 2, formed of plastic. The pivot bar base molding 2 is joined to the collar 1 by means of a hinge mechanism, indicated at 16 in FIG. 2. The hinge 16 may take the form of a transverse axle that extends through the hollow structure of the base bar molding 2 and is seated in hinge sockets 43.

The second or lower end 44 of the pivot bar 3 is indicated at 44. The lower end 44 of the pivot bar 3 is rotatable outward from the bag 15'. As shown in FIG. 2, a spring 20 biases the pivot bar 3 so as to urge the second end 44 of the pivot bar 3 outward away from the bag 15'. The spring 20 has a central, U-shaped region that bears against the inwardly facing underside of the plastic pivot bar base molding 2. The intermediate portions of the spring 20 are coiled about the pin 16. The ends of the spring 20 bear against the front side of the collar 1. The spring 20 thereby biases the pivot bar 3 in the counterclockwise direction as viewed in FIG. 1.

Each leg 4 is rotatably attached at its upper extremity 41 to the second end 44 of the pivot bar 3 by means of a separate leg connection pin 17. Each leg 4 has a leg hinge insert 26 inserted into its upper extremity 41. The leg connection pins 17 ace inserted through holes in the leg hinge inserts 26 and through holes in the walls of the second end 44 of the pivot bar 3. The leg connection pins 17 allow the legs 4 to rotate laterally from the pivot bar 3 in a common plane transverse to the path of movement 40 indicated in FIG. 1 in the directions indicated by the directional arrows 59 in FIG. 2, and to open to their full, extended positions shown in FIGS. 2, 3 and 6.

Referring to the more detailed views of FIGS. 3, 6, 7 and 8, the relationship of the struts 7 with the legs 4 and slide 6 can be seen. The spring mechanism 20, shown in FIG. 2, provides the force necessary to rotate the pivot bar base molding 2 outwardly in rotation about the axis of the pivot bar hinge axle 16 relative to the collar molding 1 when the spring 20 is unrestrained by the cord 9. As the pivot bar base molding 2 is rotated on the hinge axle 16 outwardly away from the bag 15', it carries the second end 44 of the pivot bar 3 with it. The spring 20 acts with sufficient force to also activate the slide 6, move the struts 7, and deploy the legs 4.

One of the major components of the bag and stand combination 15 is the rigid pivoting slide activating rod 5, which is attached to the collar 1 by means of a collar hinge pin 19 and which is attached to the slide 6 by means of a slide hinge pin 19'. When the spring 20 forces the pivot bar 3 outwardly away from the bag 15, as indicated in FIG. 1, the slide activating rod 5 likewise pivots outwardly from the bag 15' in rotation about the collar hinge pin 19.

Figure 3:
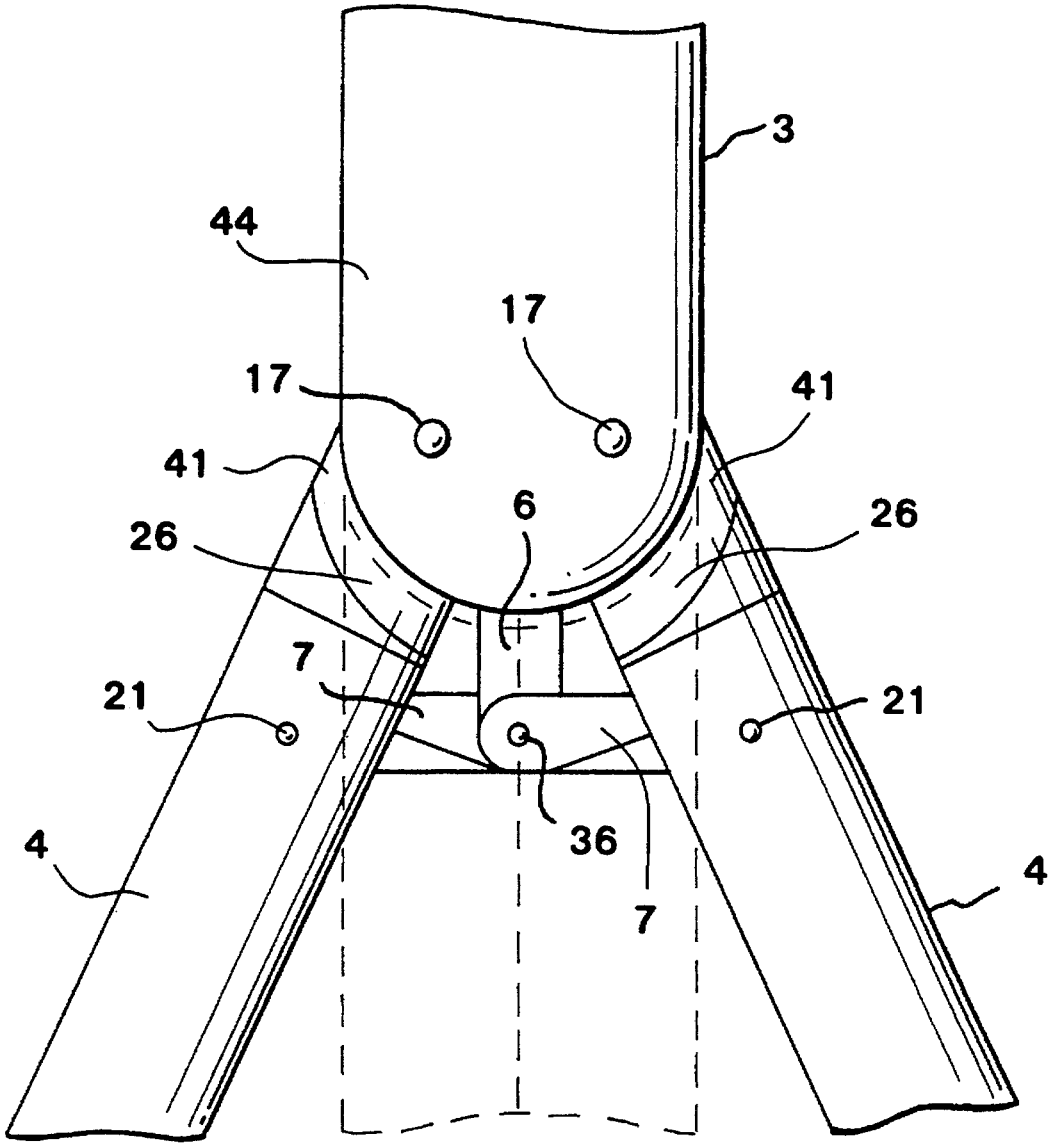
FIG. 3 is a front elevational detail of a portion of the stand shown in FIG. 2.
Figure 8:
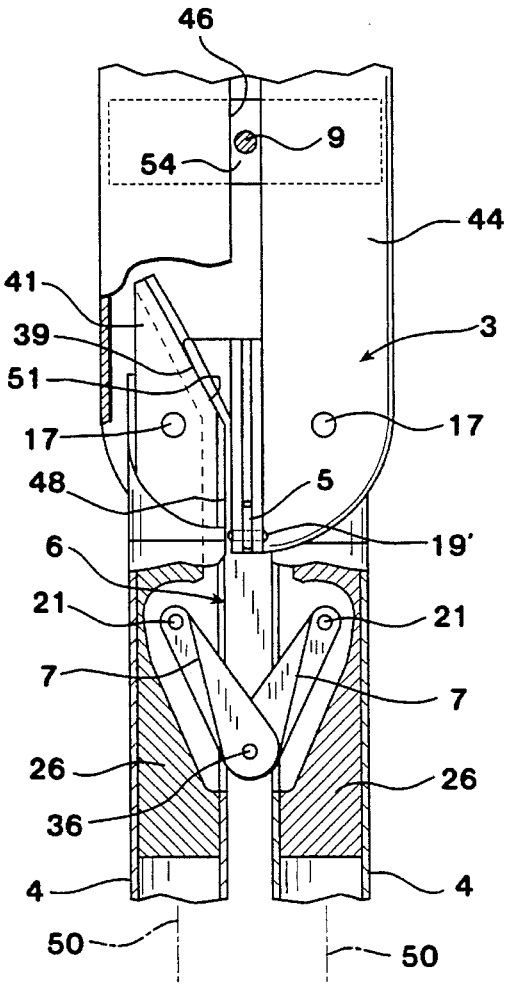
FIG. 8 is a detail, partially broken away and partial in section, taken along the lines 6—6 of FIG. 1 and showing the legs in a fully retracted position.
Figure 7:
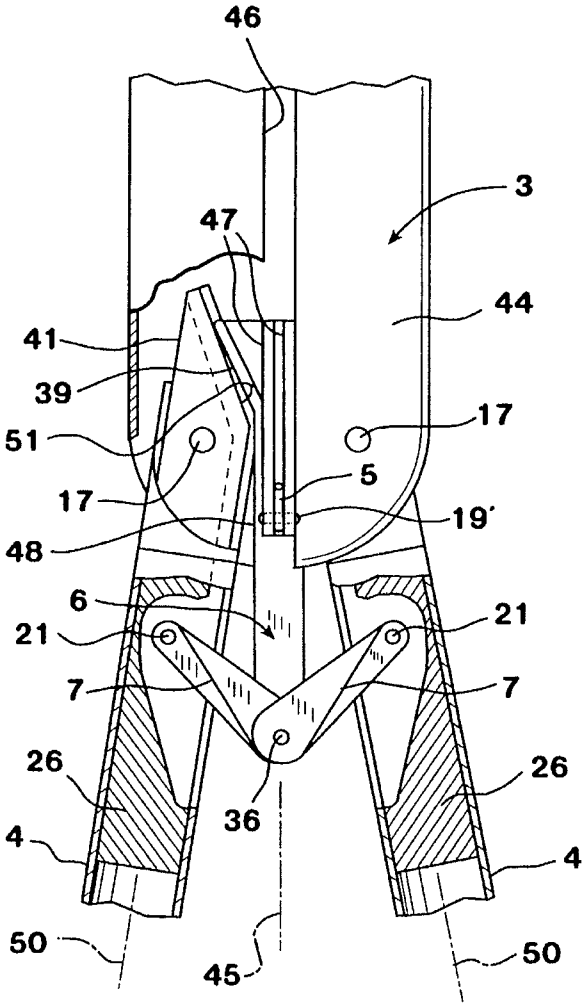
FIG. 7 is a detail, partially broken away and partially in section, taken along the lines 6—6 of FIG. 1 showing the legs at an intermediate position between a fully extended and fully retracted position.
Figure 6:
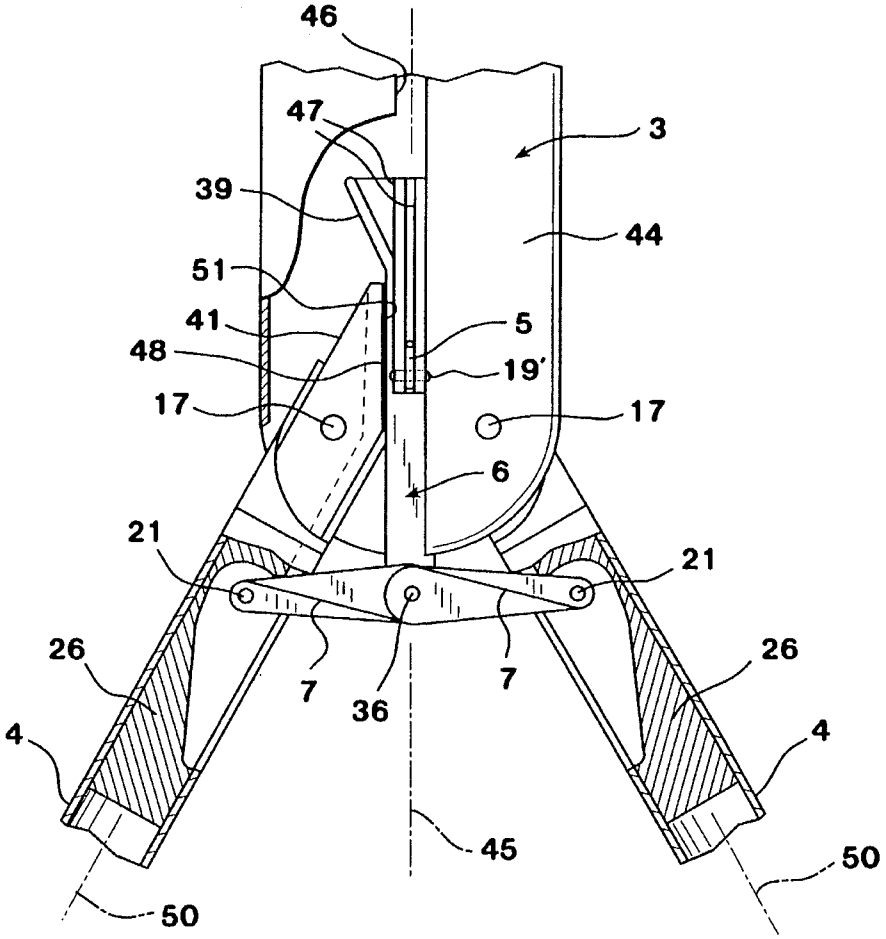
FIG. 6 is a detail, partially broken away and partially in section, taken along the lines 6—6 of FIG. 1 and showing the legs in an extended position.

Since the slide activating rod 5 is rotatably fastened to the slide 6 by means of the slide hinge pin 19', the slide activating rod 5 retracts the slide 6 from the position shown in FIG. 8, through the intermediate position shown in FIG. 7, and into the pivot bar 3 as shown in FIGS. 3 and 6. That is, the leg activation slide 6 is restrained or "held back" by the rod 5, relative to the pivot bar 3, as the pivot bar 3 rotates outward under the biasing force of the spring 20. The "holding back" feature retracts the slide 6 relative to the pivot bar 3 from the position of FIG. 6, in which the legs 4 are nested within the elongated recess 14' of the elongated housing 14 shown in FIGS. 1 and 8. The slide 6 moves through the intermediate position of FIG. 7, and into the position of FIGS. 3 and 6.

Since the pivot bar 3 moves relative to the slide 6, the pivot bar 3 forces the leg struts 7 to rotate outwardly about pin 36 into an orientation perpendicular to the length of the slide 6 as shown in FIGS. 3 and 6. Each of the leg struts 7 is connected to a separate one of the legs 4. As the leg struts 7 are rotated apart from each other and into an orientation perpendicular to the slide 6, as shown in FIGS. 3 and 6, the distal or lower extremities 42 of the legs 4 are spread outwardly away from each other to their fully extended positions shown in FIGS. 2, 3 and 6.

Figure 5:
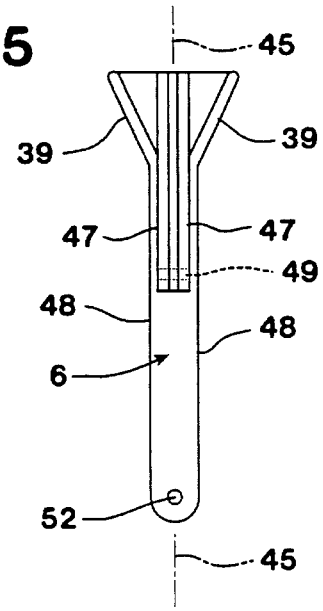
FIG. 5 is a rear elevational view showing the slide of FIG. 3 in isolation.
Figure 9:
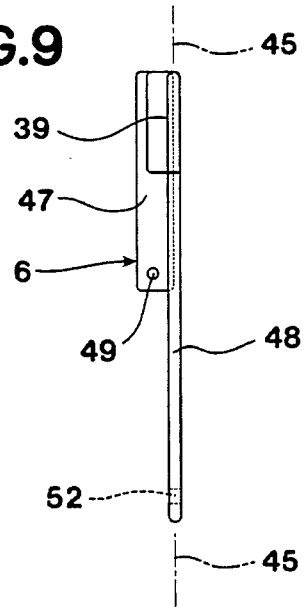
FIG. 9 is a side elevational view of the slide of FIG. 5.

The slide 6 is illustrated in detail and in isolation in FIGS. 5 and 9. The slide 6 is a relatively narrow structure having a longitudinal axis indicated at 45. As shown FIGS. 6, 7, and 8, the slide 6 fits within the lower end 44 of the pivot bar 3 where it is laterally constrained in its movement. The lower end 44 of the pivot bar 3 is formed as an aluminum extrusion of a generally "C-shaped cross sectional configuration having a longitudinally extending open slot 46 at its center facing the front of the bag 15'. The slide 6 is formed with a pair of outwardly projecting ears 47 that protrude through the slot 46 in the lower end 44 of the pivot bar 3. The slot 46 thereby forms a longitudinal guide that laterally constrains and guides the movement of the ears 47 so that the slide 6 can move longitudinally along the slide 46, but is laterally constrained against movement relative thereto.

The rigid rod 5 has an offset section at its center so that its lower portion will extend upwardly beyond the upper extremity of the slide 6, in between the ears 47 thereof, and so that its upper portion can enter into the slot 46 defined in the lower end of the pivot bar 3 and into the cavity defined in the underside of the pivot bar base molding 2. This allows the legs 4 and the leg extension and retraction means to be fully withdrawn into the hollow, forwardly facing channel 14' that is formed in the elongated housing 14.

The slide 6 has a pair of outwardly facing longitudinally extending flat surfaces 48 that face in opposite lateral directions and extend parallel to the slide axis 45. Above the longitudinally extending flat surfaces 48 the slide 6 is provided with a pair of cam surfaces 39 that diverge upwardly and laterally outwardly at an acute angle of about 26 degrees relative to the outwardly facing, longitudinally extending flat surfaces 48. One end of the rigid rod 5 is secured to the slide 6 by means of the transverse slide hinge pin 19' that passes through the openings 49 in the slide ears 47. Thus, the pivot pin 19' is held at a fixed distance from the collar hinge pin 19 by means of the rigid rod 5.

As shown in FIGS. 8 and 9, each of the legs 4 has a longitudinal axis 50. The upper extremities 41 of the legs 4 both have bearing surfaces 51 that extend at an acute angle that is supplementary to the obtuse angle between the flat surfaces 48 and 39 of the slide 6. Preferably the flat surfaces 39 and 48 of the slide 6 form an obtuse angle relative to each other of 154 degrees. The bearing surfaces 51 of the legs 4 therefore form an angle of 26 degrees relative to each of the leg axes 50.

As shown if FIG. 6, the bearing surfaces 51 of the upper extremities 41 of the legs 4 bear against the outwardly facing, longitudinally extending flat surfaces 48 of the slide 6 in face-to-face disposition thereagainst when the lower extremities 42 of the legs 4 are forced fully apart from each other as shown in FIGS. 2 and 6. Conversely, the bearing surfaces 51 of the upper extremities 41 of the legs 4 bear against the cam surfaces 39 of the slide 6 in face-to-face disposition thereagainst when the lower extremities 42 of the legs 4 are collapsed together when the stand is in its fully retracted position. The cam surfaces aid in forcing the distal extremities 42 of the legs 4 together when the stand is collapsed as is evident in FIGS. 7 and 8. As shown in FIGS. 6, 7 and 8 the cam surfaces 39 serve to force the legs 4 in counter-rotation about their respective pivot pins 21, thereby bringing the distal ends 42 of the legs 4 together. The cam surfaces 39 thereby provide a wedging action to force the legs 4 together.

As may be seen in FIG. 1, the leg activation struts 7 are attached by means of a pivot pin 36 to the bottom of the slide 6 through the aperture 52 therein and to the legs 4 at their distal ends by pivots pins 21. The pins 21 are attached to legs 4 below the leg connection pins 17 at the upper extremities 41 of the legs 4 as shown in FIG. 8. When the stand is in its retracted position the pivot pin 36 that attaches the slide 6 to the struts 7 is positioned below the pivot pins 21. As the slide 6 is retracted into the pivot bar 3 from the position of FIG. 8, as shown in FIG. 7, the slide 6 pulls the struts 7 and spreads them as the slide 6 moves away from the end 44 of the pivot bar 3 and toward the pivot bar base molding 2. As the spring 20 forces the pivot bar base molding 2 outwardly in a counterclockwise direction, as viewed in FIG. 1, the rod 5 pulls the slide 6 up the slot 46 toward the leg connection pins 17 within the second end 44 of the pivot bar 3. This spreads the struts 7 laterally outwardly until the slide 6 and struts 7 form an inverted "T", such that the pins 21 are in a horizontal line in alignment with the pivot pin 36 and perpendicular to the axis 45 of the slide 6.

Referring to FIGS. 1, 10, 11, and 12, the activation handle or handgrip 8 is a key component in the combination bag and stand assembly 15. The activation handle 8 provides the leverage required to pull the cord 9 which retracts the leg extension and retraction means.

The handgrip 8 has an upper extremity that is attached to the collar 1 by means of a pivot pin 18 at the back of the bag 15'. The lower end of the handgrip 8 is connected to the cord 9. The cord 9 is a strong, flexible, lightweight cord. One end of the cord 9 is attached to an anchor plate 54 that is captured within the lower end 44 of the pivot bar 3. The anchor plate 54 is free to move reciprocally, longitudinally within the lower end 44 of the pivot bar 3 independently of the slide 6. The anchor plate 54 is laterally restrained, however, since the cord 9 passes from the pivot bar 3 through the slot 46 therein.

Figure 12:
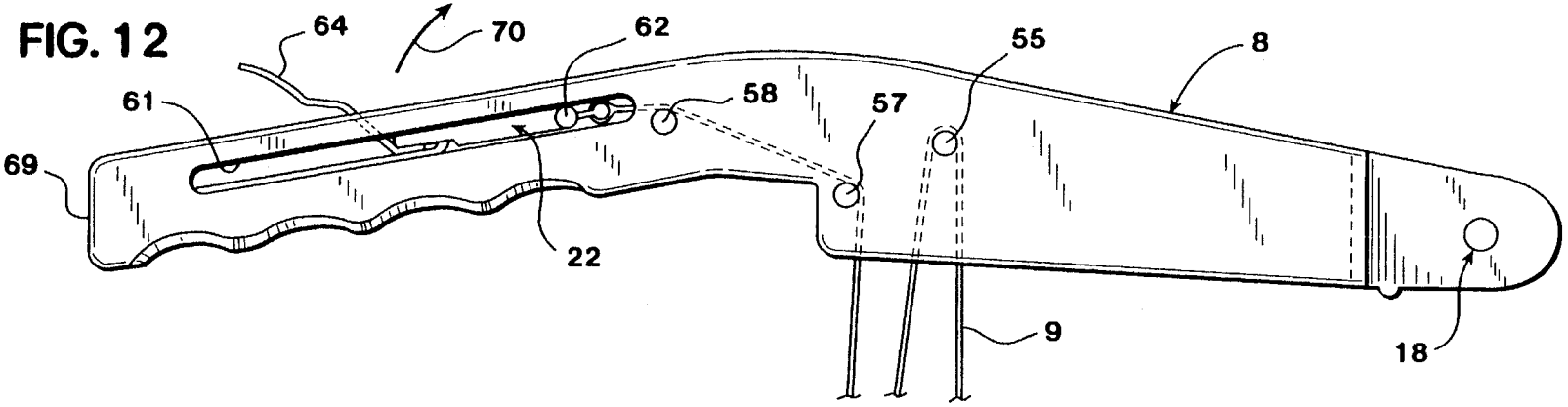
FIG. 12 is a side elevational view of the carry handle, buckle, and loop strap of FIG. 10.

The cord 9 passes across an internal roller (not shown) in the housing 14 and is threaded directly into a free and unobstructed tube 10. The tube 10 is formed of plastic and extends through the structure of the bag 15' from the front to the back. The tube 10 is open at both ends. As shown in FIG. 12, the cord 10 is threaded about another pulley 55 in the handgrip 8, back through a turning roller 56 mounted in the bag 15', and across additional turning rollers 57 and 58 that are mounted in the handgrip 8.

Figure 11:
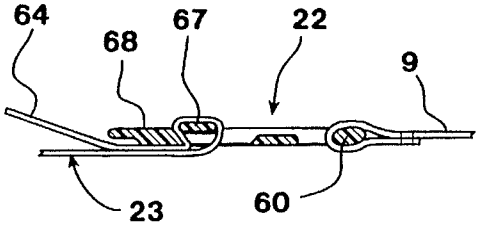
FIG. 11 is a sectional detail taken along the lines 11—11 of FIG. 10.
Figure 10:
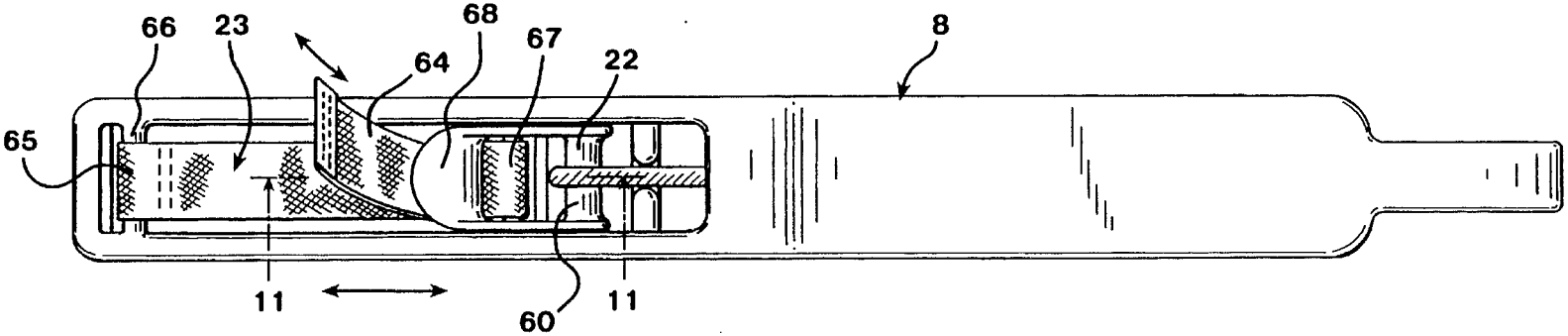
FIG. 10 is a rear elevational detail of the carry handle handgrip, buckle, and loop strap shown in FIG. 1.

A sliding buckle 22 is attached to the activation cord 9. As shown in FIG. 11, the activation cord 9 is looped about a forward cross bar 60 of the buckle 22, and is permanently secured thereto. The buckle 22 slides along the length of slots 61 defined in the structure of the free end of the handgrip 8. The buckle 22 has a pair of laterally projecting guide pins 62 that extend outwardly into the slots 61 on both sides of handgrip 8.

The position of the sliding buckle 22 can be adjusted by retracting or releasing the protruding end 64 of the loop strap 23. The loop strap 23 is approximately three quarters of an inch wide. One end 65 of the loop strap 23 is wrapped about and secured by stitching to a cross bar 66 in the handgrip 8 at the very end of the free extremity 69 thereof. The loop strap 23 then extends toward the buckle 22 and is wrapped about a raised bridging bar 67 thereof. The loop strap 23 passes back downwardly underneath the buckle 22 and beneath a rear transverse cinch bar 68 thereof.

The tortuous path of the loop strap 23 through the transverse bars 67 and 68 and the friction of the loop strap 23 against itself will cinch the loop strap 23 tight when the free end 64 thereof is pulled away from the handgrip hinge 18. When the loop strap 23 is cinched tight in this fashion, the buckle 22 is pulled to the furthest extent possible away from the handgrip hinge 18. The effective length of the portion of the loop strap 23 under tension is thereupon at its minimum, thus pulling a portion of the cord 9 away from the handgrip hinge 18 and toward the distal end of the handgrip 8. The loop strap 23 and the buckle 22 thereon thereby hold the stand completely retracted into the hollow channel 14' in the housing 14.

The effective length of the loop strap 23 that is under tension is reduced by pulling on the free end 64 thereof away from the handgrip hinge 18. This draws the sliding buckle 22 toward the free end extremity 69 of the handgrip 8. This in turn draws the cord 9 to securely retract the pivot bar 3 and the legs 4 for storage.

When preparing the device of the invention for use from a stored condition, the rear transverse cinch bar 68 of the buckle 22 is lifted, thus rotating the buckle 22 in a clockwise direction as indicated by the directional arrow 70 in FIG. 12. The frictional force on the loop strap 23 is thereupon reduced, thus releasing the loop strap 23. This allows the spring 20 to push outwardly and forwardly on the pivot bar base molding 2. The spring 20 thereupon forces the leg stand to its full, extended position, shown in FIG. 1. The cord 9 is attached to the sliding buckle 22 which slides up and down in the handle 8. The buckle 22 can be cinched tight to retract the stand when the free end of the loop strap 23 is pulled closed, thereby again retracting the leg stand mechanism for storage in the channel 14' of the housing 14 when the bag 15' is not is use.

The golf bag and self-deploying stand assembly 15 of the invention is also provided with a shoulder strap 24. As shown in FIG. 1, the collar 1 is formed with a relatively narrow bridge 73 that defines an opening 71 at the upper rear of the collar 1. The bridge 73 and the opening 71 thereby form a handhold that accommodates a loop 74 at one end of the shoulder strap 24. In addition, a golfer can seize the bag 15' by the handhold 73 and carry it or reposition it, leaving the legs 4 extended as shown in FIG. 1.

The shoulder strap 24 is secured by the loop 74 to the bridge 73 of the collar 1 at one end and to the free extremity 69 of the handgrip 8 by means of a loop 77 at its opposite end. The shoulder strap 24 is preferably provided with an adjustment buckle 79, that may have the same construction as the buckle 22 depicted in FIGS. 10–12. The buckle 79 allows the length of the loop formed by the shoulder strap 24 to be varied.

The shoulder strap 24 also includes a fixed coupling 33 that is connected to a strap 80 secured to the bag 15' by a quick disconnect buckle 82. The quick disconnect buckle 82 has coupling elements releasably connected together. One of the coupling elements is mounted on the end of the strap 80, while the other coupling element is attached to a mounting loop on the bag 15'.

A portion of the bag 15' is broken away in FIG. 1 to allow illustration of the cord 9 and the tube 10 through which the cord 9 moves in longitudinal reciprocal fashion. The tube 10 is a hollow rigid structure of rectangular cross section approximately one quarter inch in width and about two inches in height. The tube 10 is sufficiently long to extend from the front to the back of the bag 15' and to allow the cord 9 to easily slide through the channel 10. This allows free extension and retraction of the legs 4.

Figure 4:
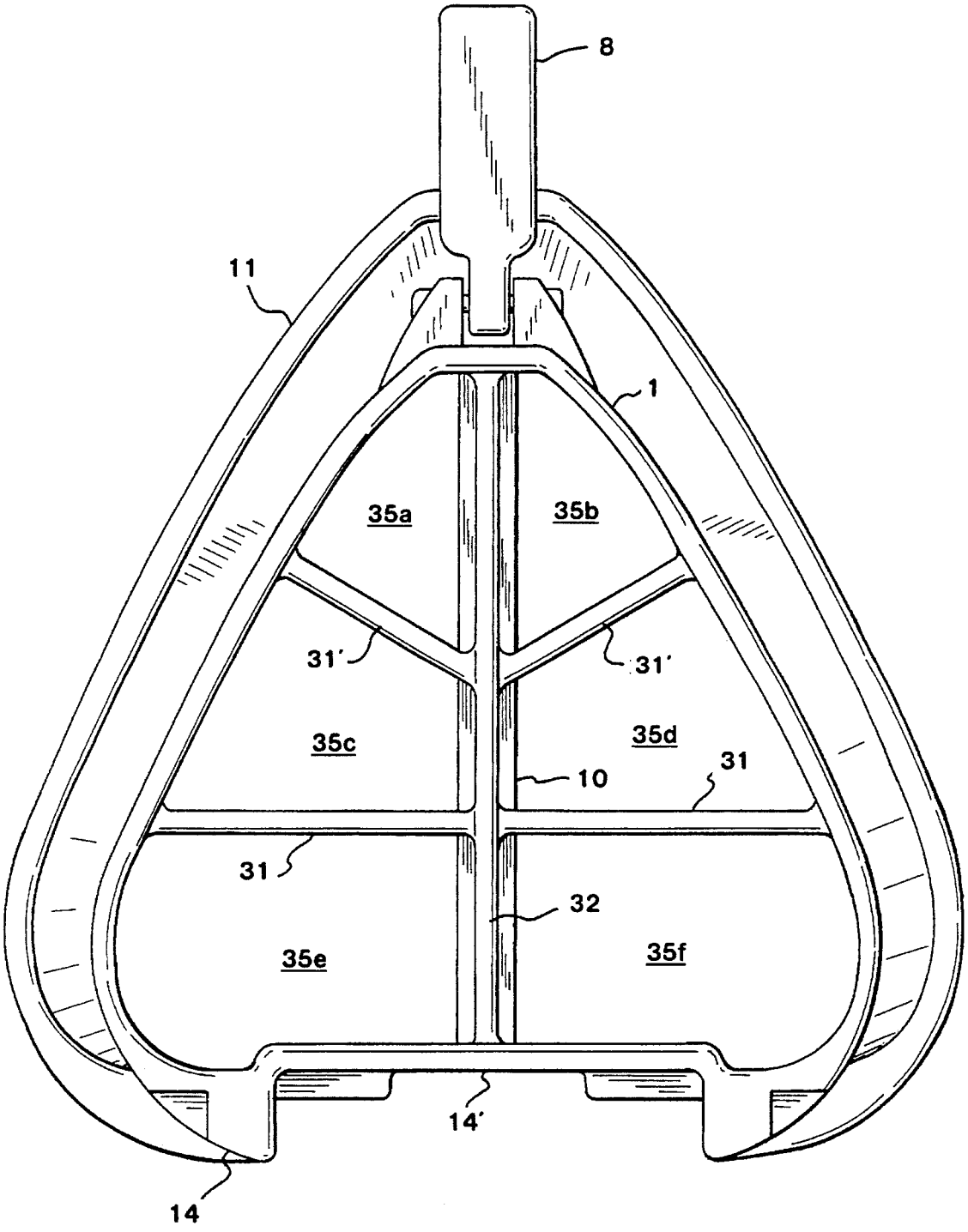
FIG. 4 is a top view of the golf bag taken along the lines 4—4 of FIG. 1 showing the configuration of the organizing compartments.

FIG. 4 is a top view of the collar 1 taken along the lines 4—4 thereof. FIG. 4 illustrates the golf club organization and storage features of the invention. FIG. 4 illustrates two sets of three compartments each segmented by dividers 31 that appear horizontal and dividers 31' that extend laterally in the plane of FIG. 4. The compartments are bisected by one divider 32 that appears vertical in the plane of FIG. 4, resulting in a total of six separate compartments **35*a*, 35*b*, 35*c*, 35*d*, 35*e* and 35*f*. The six compartments 35*a*–35*f*** assist the golfer to facilitate golf club storage and retrieval.

Undoubtedly, numerous variations and modifications of the invention will become readily apparent to those familiar with collapsible golf bag stands. Accordingly, the scope of the invention should not be construed as limited this specific embodiment depicted and described.

I claim:

1. A golf bag and automatic stand for supporting said bag in an upright position comprising in combination:

(a) a golf bag having a front and a back and suited for holding and organizing golf clubs therein and having upper and lower extremities, a collar on said upper extremity of said bag, a base on said lower extremity of said bag, and a housing extending between said collar and said base at said front of said bag and defining therein a single concave elongated recess extending longitudinally along said front of said bag, (b) an automatic bag stand including a pivot bar having first and second ends, bar hinge means that rotatably attach said first end of said pivot bar to said collar at said front of said bag so that said second end of said pivot bar is rotatable outward from said bag, a spring biasing said pivot bar so as to urge said second end of said pivot bar to rotate outward away from said bag, a pair of legs having upper and lower extremities, leg connection means joining said upper extremities of said legs to said second end of said pivot bar so that said legs are rotatable relative to said pivot bar and extend therefrom, a leg extension and retraction means coupled to said legs and to said pivot bar and which forces said lower extremities of said legs apart from each other when said second end of said pivot bar is rotated outward away from said bag and which collapses said lower extremities of said legs together when said bias of said spring is overcome, a cord passing through said bag from back to front and coupled to said pivot bar, and an activation handgrip having an upper extremity and a lower end, a handgrip hinge means connecting said upper extremity of said handgrip to said collar at said back of said bag and wherein said lower end of said handgrip is connected to said cord, whereby when said lower end of said handgrip is pulled outwardly away from said back of said bag, said cord draws said leg extension and retraction means toward said front of said bag so that said legs are collapsed together and pulled into said single elongated recess and when said handgrip is released said spring pushes said pivot bar outward from said bag and said lower extremities of said legs are forced apart.

2. A golf bag and automatic stand according to claim 1 wherein said leg extension and retraction means is comprised of a slide movable reciprocally relative to said pivot bar as said pivot bar rotates relative to said bag, a rod pivotally connected to said bag beneath said bar and to said slide to thereby cause said slide to retract into said bar as said bar rotates outward away from said bag, and a pair of lever struts both pivotally connected to said slide and to separate ones of said legs below said upper extremities thereof, whereby said lever struts are both pulled into an orientation perpendicular to said slide when said bar is rotated outwardly from said bag to thereby cause said legs to open from each other and extend laterally from said bag.

3. A golf bag and automatic stand according to claim 2 further comprising a hollow tube extending through said bag from said front to said back thereof and through which said cord passes to allow clear, unobstructed movement of said cord therein, and wherein said bag is equipped with a shoulder strap having one end attached to said collar and another end attached to said lower end of said handgrip.

4. A golf club bag and automatic stand according to claim 2 further characterized in that said slide has a longitudinal axis that extends parallel to said pivot bar, a pair of outwardly facing longitudinally extending flat surfaces facing in opposite lateral directions and extending parallel to said slide axis, and a pair of flat cam surfaces located above said outwardly facing, longitudinally extending surfaces, wherein said cam surfaces diverge upwardly and laterally outwardly at an obtuse angle relative to said outwardly facing, longitudinally extending flat surfaces, and each of said legs has a longitudinal axis and said upper extremities of said legs both have bearing surfaces extending at an acute angle relative to their respective axes that is supplementary relative to the aforesaid obtuse angle, and whereby said bearing surfaces of said upper extremities of said legs bear against said outwardly facing, longitudinally extending flat surfaces of said slide in face-to-face disposition thereagainst when said lower extremities of said legs are forced apart from each other, and said bearing surfaces bear against said cam surfaces of said slide in face-to-face disposition thereagainst when said lower extremities of said legs are collapsed together.

5. A golf bag and automatic stand according to claim 1 wherein said collar and said base are molded structures and said handgrip is mounted on said collar, and wherein said base is larger in area than said collar.

6. A golf bag and automatic stand according to claim 1 further comprising a strap retraction mechanism coupled to said bag and to said handgrip, and said strap retraction mechanism is adjustable in length to thereby secure said bag stand in a retracted position when not in use.

* * * * *